US008733017B2

(12) United States Patent
Marsden et al.

(10) Patent No.: US 8,733,017 B2
(45) Date of Patent: May 27, 2014

(54) SECURITY GATE WITH LOCK STATUS INDICATOR

(71) Applicants: Andrew W. Marsden, Hingham, MA (US); Raul G. Pereira, Cumberland, RI (US); Jim R. Varney, Maynard, MA (US); Bryan R. Hotaling, Harvard, MA (US)

(72) Inventors: Andrew W. Marsden, Hingham, MA (US); Raul G. Pereira, Cumberland, RI (US); Jim R. Varney, Maynard, MA (US); Bryan R. Hotaling, Harvard, MA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 13/633,709

(22) Filed: Oct. 2, 2012

(65) Prior Publication Data

US 2013/0086840 A1 Apr. 11, 2013

Related U.S. Application Data

(60) Provisional application No. 61/544,891, filed on Oct. 7, 2011.

(51) Int. Cl.
*G08B 5/14* (2006.01)
*E05F 15/12* (2006.01)

(52) U.S. Cl.
USPC ..... 49/55; 49/333; 49/386; 49/56

(58) Field of Classification Search
CPC ..... E05B 79/06; E05B 85/12; E05B 77/04; E05B 77/02
USPC ..... 49/50, 55–57, 324, 333, 339, 364, 379, 49/386
See application file for complete search history.

(56) References Cited

U.S. PATENT DOCUMENTS

| | | | | |
|---|---|---|---|---|
| 1,996,196 | A | 4/1935 | Ferris | |
| 4,000,540 | A | 1/1977 | Newlon | |
| 5,193,647 | A * | 3/1993 | O'Brien, II | 185/40 R |
| 6,016,629 | A | 1/2000 | Sylvester et al. | |
| 6,079,157 | A * | 6/2000 | Hincher, Sr. | 49/57 |
| 6,253,490 | B1 * | 7/2001 | Postans | 49/55 |
| 6,499,254 | B2 | 12/2002 | Rossman et al. | |
| 6,711,857 | B1 * | 3/2004 | Wagnitz et al. | 49/394 |
| 7,131,235 | B2 | 11/2006 | Hicks | |
| 7,318,298 | B2 * | 1/2008 | Marsden et al. | 49/57 |
| 7,334,624 | B2 | 2/2008 | Waldman et al. | |
| 7,373,755 | B2 * | 5/2008 | Jefferys et al. | 49/55 |
| 7,540,046 | B1 | 6/2009 | Lai | |
| 7,627,985 | B2 | 12/2009 | Marsden et al. | |
| 8,347,555 | B2 * | 1/2013 | Chen | 49/394 |
| 8,468,743 | B2 * | 6/2013 | Ting et al. | 49/57 |
| 2003/0097793 | A1 * | 5/2003 | Kowalczyk et al. | 49/333 |

(Continued)

FOREIGN PATENT DOCUMENTS

WO 2010097101 9/2010

OTHER PUBLICATIONS

International Search Report and Written Opinion related to International Application No. PCT/US12/58615.

*Primary Examiner* — Katherine Mitchell
*Assistant Examiner* — Justin Rephann
(74) *Attorney, Agent, or Firm* — Barnes & Thornburg LLP

(57) ABSTRACT

A gate is mounted to pivot about a pivot axis between opened and closed positions. A latch is mounted for movement relative to the gate to retain the gate in a closed and locked position.

24 Claims, 8 Drawing Sheets

(56) References Cited

U.S. PATENT DOCUMENTS

2005/0028947 A1* 2/2005 Waldman et al. ..... 160/215
2006/0207180 A1* 9/2006 Cheng ..... 49/57
2007/0022666 A1* 2/2007 Andersen et al. ..... 49/394
2007/0079555 A1* 4/2007 Lan ..... 49/57
2009/0013604 A1 1/2009 Yates
2012/0324792 A1* 12/2012 Bertsch et al. ..... 49/37
2013/0118088 A1* 5/2013 Yates ..... 49/386

* cited by examiner

SECURITY GATE WITH LOCK STATUS INDICATOR

PRIORITY CLAIM

This application claims priority under 35 U.S.C. §119(e) to U.S. Provisional Application Ser. No. 61/544,891, filed Oct. 7, 2011, which is expressly incorporated by reference herein.

BACKGROUND

The present disclosure relates to movable barriers, and particularly to security gates. More particularly, the present disclosure relates to juvenile gates for use inside a dwelling.

SUMMARY

A gate unit in accordance with the present disclosure includes a gate that can be moved about a pivot axis by a person between closed and opened positions. The gate unit also includes a latch that is movable relative to the gate to retain the gate in the closed position and establish a locked mode of the gate.

In illustrative embodiments, the gate unit also includes a gate mount that is adapted to mate with a door frame bordering a doorway. The gate is mounted on upper and lower hinges included in the gate mount for pivotable movement about the pivot axis between a closed position closing a walkway passage formed in the gate mount to block movement of a person through the walkway passage to an opened position opening the walkway passage to allow movement of a person through the walkway passage. The latch is carried on the pivotable gate and arranged to engage a latch receiver provided in the gate mount to lock the gate in the closed position.

In illustrative embodiments, a gate-open signaler in accordance with the present disclosure functions to provide a visual lock-status signal to a nearby observer that the gate is not locked, even though it may appear to be closed and locked. The gate-open signaler is activated automatically if a caregiver does not latch or lock the gate properly to cause the gate to swing into an opened position to give the caregiver a visible cue that the gate was not latched or locked properly. The gate-open signaler is included in the gate unit and located in an interior region of the upper hinge included in the gate mount. The gate-one signaler always operates to move a closed but unlocked gate about the pivot axis to a visibly opened position to signal to a nearby observer that the gate is not locked.

In illustrative embodiments, the gate-open signaler includes a cam that is located inside the upper hinge of the gate mount and is arranged to rotate about the pivot axis whenever the gate pivots about the pivot axis. The upper hinge includes a pivot coupled to the gate and centered on the pivot axis and a pivot support coupled to a wall panel include in the gate mount and support the pivot for rotation about the pivot axis so that the gate is also pivotable about the pivot axis. The gate-open signaler also includes a spring-loaded cam follower arranged to engage and ride on cam surfaces included in the cam. The cam follower is moved by the spring to engage one of the cam surfaces to apply a rotation-inducing torque to the cam to cause the cam, pivot, and gate to rotate as a unit to a visibly opened position of the gate when the gate is nearly closed or closed but unlocked.

In use, in the case of a closed but unlocked gate, the spring-loaded cam follower applies a force to a cam surface on the cam that acts to apply a rotation inducing torque to the cam. This rotation-inducing torque is transferred to the gate via components included in the upper hinge of the gate mount to cause the gate to swing automatically to a position that is clearly opened as long as the gate was not locked in the closed position by proper engagement of the latch with the gate mount. A gate-open signaler in accordance with the present disclosure is configured to provide means for (1) automatically moving the gate relative to the gate mount from a closed (or nearly closed) position (as long as the gate is unlocked) through a displacement angle to a visibly opened position to create a visible gap between an upright outer edge of the gate and a neighboring upright outer edge of the gate mount to establish an unlocked mode of the gate and for (2) maintaining the gate in such a visibly opened position until a user moves the gate back to the closed position and operates the latch properly to engage the gate mount to retain the gate in a closed and locked position.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 4 is a diagrammatic top plan view showing the gate in a fully opened position and suggesting that the gate will move toward a closed position in response to application of a FIRST PUSHING FORCE by a caregiver;

FIG. 5 is a view similar to FIG. 4 showing that a caregiver has moved the gate in a counterclockwise direction nearly to the closed position but then released the gate while it is still in unlocked mode (and before it reaches locked mode) and suggesting by means of the curved double arrow icon that the gate-open signaler has been activated to apply a clockwise torque to the gate to cause the gate to move about the vertical pivot axis away from the closed position toward a clearly opened position shown in FIG. 6;

FIG. 6 is a view similar to FIGS. 4 and 5 showing that the gate-open signaler has moved the gate about the vertical pivot axis in a clockwise direction through an acute displacement angle to an opened position automatically to establish an unlocked mode of the gate to create a visible gap between a free outer edge of the gate and a neighboring outer edge of a left-side wall panel included in the gate mount to provide a visual lock-status signal to a nearby observer that the gate is located in the opened position and maintained in the opened position until a SECOND PUSHING FORCE is applied to the gate to once again move the gate toward the closed position;

FIG. 7 is a view similar to FIGS. 4-6 showing that the gate has been moved about the vertical pivot axis in the counterclockwise direction to the closed position in response to application of the SECOND PUSHING FORCE to the gate by a caregiver and showing that a locked mode for the gate has been established (using any suitable means such as by engagement of a latch carried on the gate with the gate mount) to retain the gate in the closed position in the locked mode so that the locked mode of the gate is visually apparent to a nearby observer;

DETAILED DESCRIPTION

Figure 1:
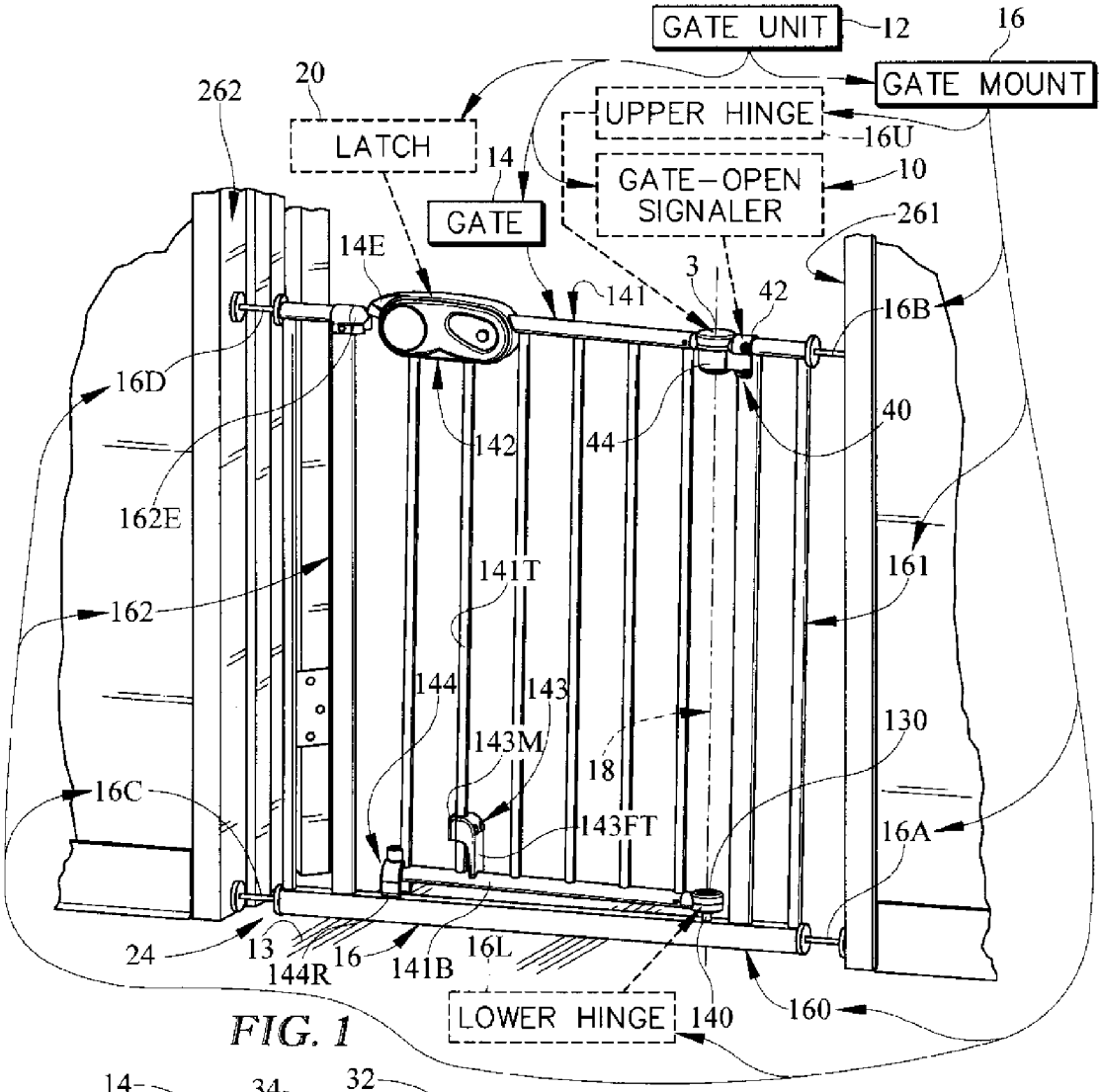
FIG. 1 is a front perspective view of a gate unit in accordance with the present disclosure placed in a doorway and showing that the gate unit includes a U-shaped gate mount mating with a door frame bordering the doorway, a gate mounted on the gate mount for swinging movement about a vertical pivot axis between a closed position shown in FIGS. 1 and 7 and various opened positions shown, for example, in FIGS. 4-6, and a latch coupled to the gate and configured to mate with a left-side portion of the gate mount to retain the gate in the closed position and suggesting that the gate unit also includes a gate-open signaler in accordance with the present disclosure and that the gate-open signaler is associated with an upper hinge included in the gate mount in a manner shown, for example, in more detail in FIGS. 8 and 9.
Figure 2:
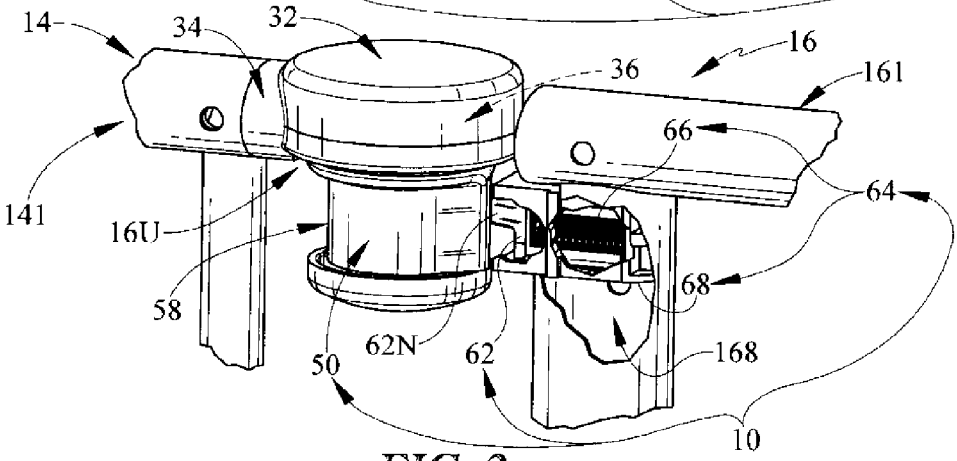
FIG. 2 is an enlarged partial perspective view of a portion of the gate unit of FIG. 1, with a pivot support included in the upper hinge omitted and portions of a first (right-side) wall panel included in the gate mount broken away to show various components cooperating to form the gate-open signaler.
Figure 8:
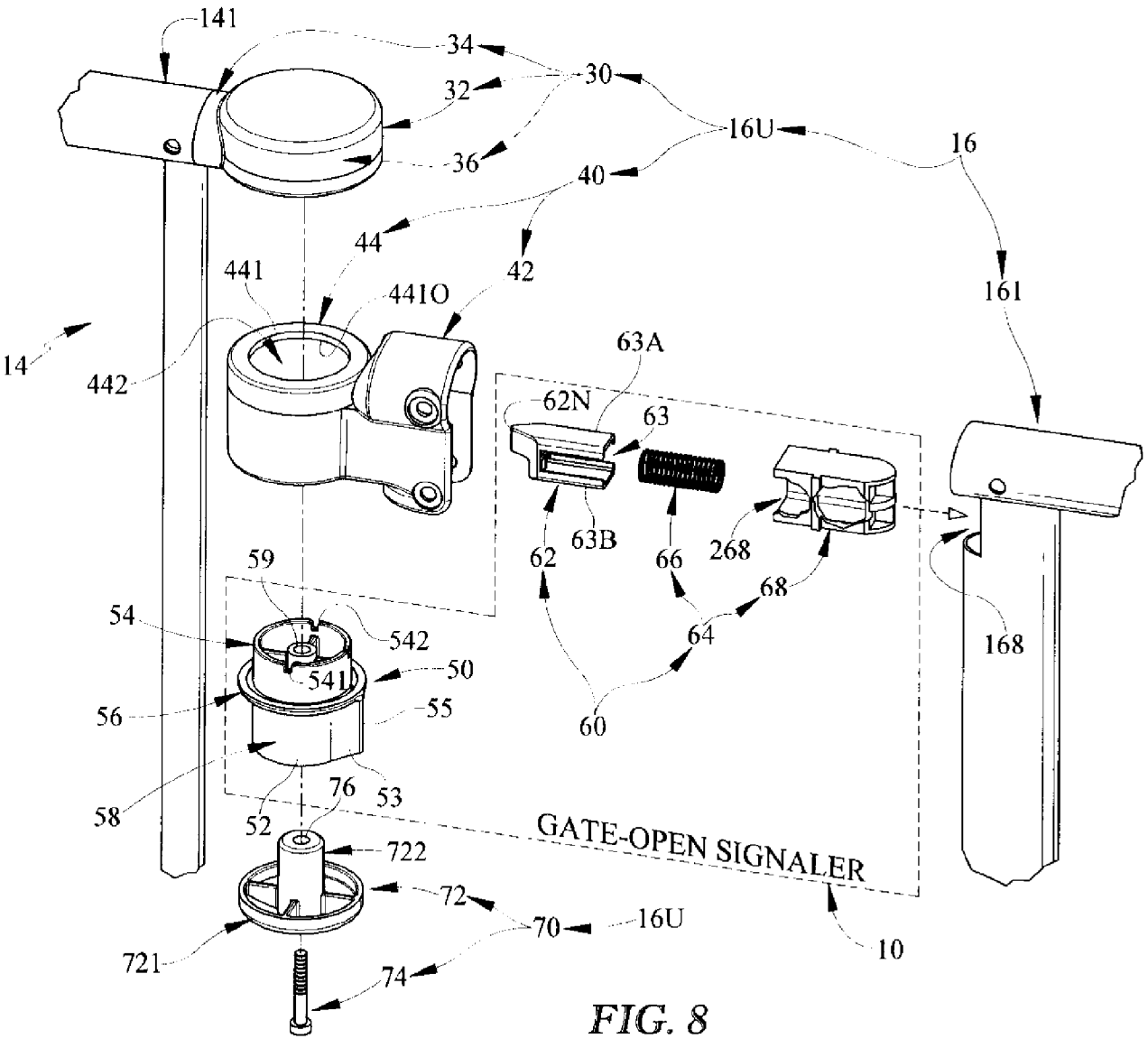
FIG. 8 is a first exploded perspective view of portions of the gate mount, gate, and gate-open signaler showing that an illustrative gate-open signaler comprises a cam sized and shaped to be mounted in an interior region of an overlying barrel included in the upper hinge of the gate mount, and a gate mover including a cam follower, a spring, and a spring mount.

A gate-open signaler 10 is included in a gate unit 12 as shown diagrammatically in FIG. 1 and illustratively in FIGS. 2 and 8. Gate-open signaler 10 operates automatically to move a closed but unlocked gate 14 to an opened position to create a clearance gap 11 between a free left-end edge 14E of gate 14 and a right-end edge 162E of a wall panel 162 included in a gate mount 16 whenever gate 14 is unlocked and closed or nearly closed as suggested in FIGS. 5 and 6. Thus, gate-open signaler 10 provides a visual lock-status signal to an observer that a gate 14 included in gate unit 12 actually is unlocked even though it may appear at first glance to be closed.

Figure 5:
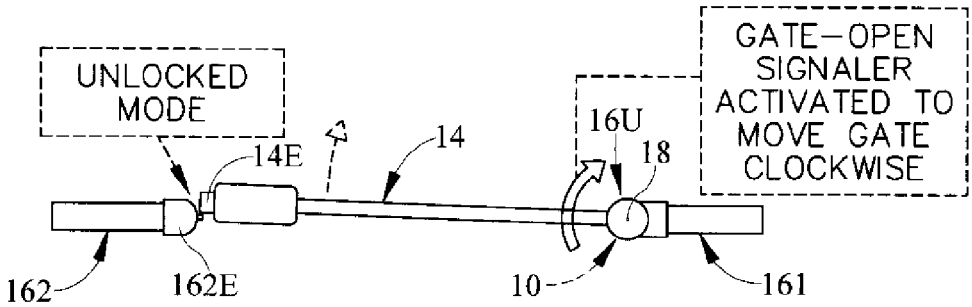
Figure 6:
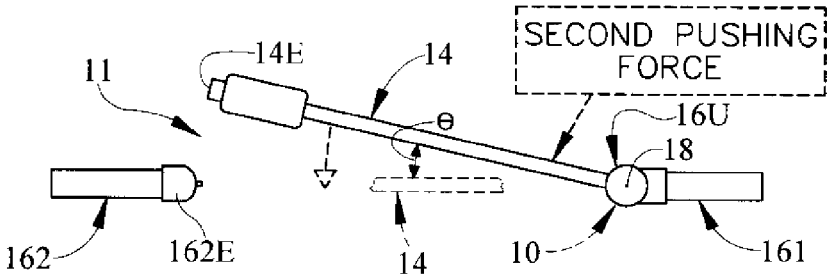
Figure 7:
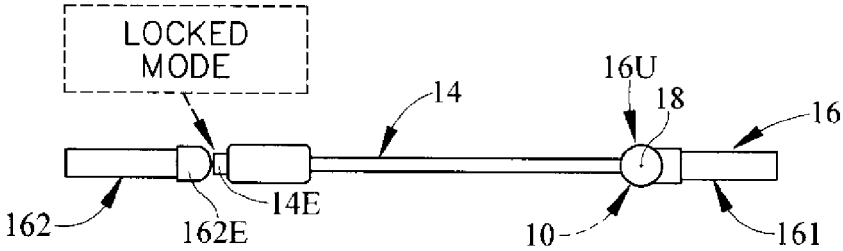

Gate-open signaler 10 is configured to provide means for normally moving gate 14 relative to a gate mount 16 also included in gate unit 12 about a vertical pivot axis 18 to a clearly opened position automatically as suggested in FIGS. 5 and 6 unless gate 14 is retained in a closed position as shown in FIGS. 1 and 7 and maintained in a locked mode by engagement of a releasable latch 20 carried on gate 14 with a portion of gate mount 16 as suggested in FIG. 1. In this way, the locked or unlocked mode of gate 14 is visually apparent to a nearby observer since gate 14 will always appear to be clearly opened as evidenced by creation of clearance gap 11 as suggested in FIG. 6 unless gate 14 is closed and locked as suggested in FIG. 7.

Gate 14 and gate mount 16 cooperate to form a doorway barrier 22 when gate unit 12 is mounted in a stationary position in a doorway 24 and gate 14 is closed and locked as suggested in FIG. 1. Gate unit 12 also includes a gate-open signaler 10 as suggested in FIGS. 1, 2, 8, and 9 and a latch 20 as suggested diagrammatically in FIG. 1.

Latch 20 may be configured and arranged in any suitable manner so that latch 20 is mounted for movement relative to doorway barrier 22 to engage gate 14 and gate mount 16 simultaneously to retain gate 14 in the closed position as suggested in FIGS. 1 and 7 to establish a locked mode of gate 14. Typically, latch 20 will be carried on gate 14 and moved relative to gate 14 to engage a portion of gate mount 16 when gate 14 is closed to establish the locked mode of gate 14. In accordance with the present disclosure, if latch 20 or other suitable lock does not engage gate 14 and gate mount 16 simultaneously to establish the locked mode of gate 14, then gate-open signaler 10 will operate automatically to apply a clockwise gate-opening torque $T_{GO}$ to move gate 14 about vertical pivot axis 18 from a closed position (or a nearly closed position) as suggested in FIG. 5 to a clearly opened position suggested in FIGS. 6 and 12 to provide a visual lock-status signal to a nearby observer that the gate is opened and unlocked.

Figure 3:
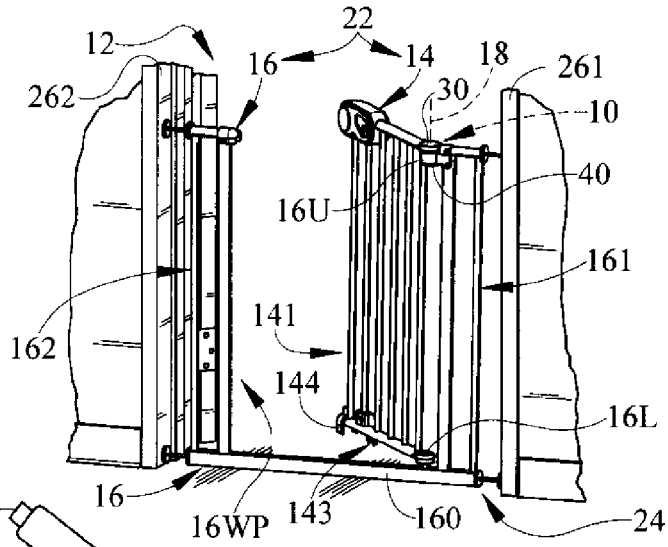
FIG. 3 is a reduced-sized front perspective view of the gate unit of FIG. 1 showing the gate after it has been pivoted in a clockwise direction about the vertical pivot axis to assume an opened position opening a walkway passage formed in the U-shaped gate mount to allow movement of a person through the walkway passage.
Figure 4:
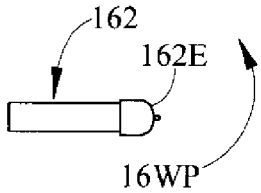
FIGS. 4-7 show an illustrative sequence showing operation of the gate-open signaler always to move a gate automatically to a position that is clearly opened to provide a visible lock-status signal to a nearby observer unless a caregiver first moves the gate to the closed position and then causes a latch carried on the gate to engage a latch receiver included in the gate mount to establish a locked mode and retain the gate in the closed position.
Figure 4:
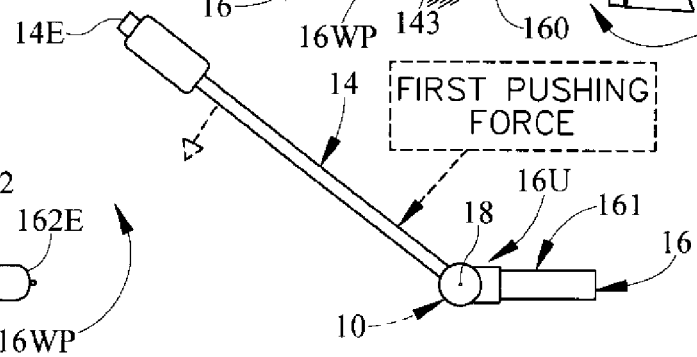

Gate 14 includes a swinging panel 141 supported on upper and lower hinges 16U, 16L included in gate mount 16 for swinging movement about vertical pivot axis 18 as shown, for example, in FIGS. 1 and 3. Gate 14 is mounted on upper and lower hinges 16U, 16L for movement between a closed position lying in substantially coplanar relation to first and second wall panels 161, 162 included in gate mount 16 a shown in FIG. 1 and a non-closed (opened) position lying in substantially non-coplanar relation to the first and second walls 161, 162 of gate mount 16 to define a displacement angle therebetween as suggested in FIGS. 3 and 4.

Gate 14 also includes a latch support 142 coupled to a free end 14E of swinging panel 141, a swing-direction controller 143 coupled to a lower portion of swinging panel 141, and a panel retainer 144 also coupled to a lower portion of swinging panel 141. Latch support 142 is configured in any suitable manner to support latch 20 for movement relative to swinging panel 141 and gate mount 16. Swing-direction controller 143 is mounted on swinging panel 141 for movement relative to swinging panel 141 for selectively controlling the swing direction of gate 14 about vertical pivot axis 18 at the option of a caregiver. Panel retainer 144 is configured to provide supplemental lock means for engaging gate mount 16 at the option of a caregiver to retain gate 14 in the closed position to supplement locking action provided by latch 20.

Gate mount 16 lies in a doorway 24 and mates with first and second doorjambs 261, 262 included in a door frame 26 bordering doorway 24 as suggested in FIG. 1. Gate mount 16 also supports gate 14 for pivotable movement about vertical pivot axis 18 when gate 14 is in the unlocked mode as suggested in FIGS. 1-6. Gate mount 16 is substantially U-shaped in an illustrative embodiment shown in FIGS. 1 and 3 and is formed to include a walkway passage 16WP through which people are able to walk when gate 14 is opened as suggested in FIG. 3.

Gate mount 16 includes a foundation rail 160 arranged to extend along floor 13, a first wall panel 161 arranged to extend upwardly from a first end of foundation 160 and lie between gate 14 and first doorjamb 261, and a second wall panel 162 arranged to extend upwardly from an opposite second end of foundation rail 160 and lie between second doorjamb 261 and gate 14 as shown, for example, in FIG. 1. Gate mount 16 also includes a doorjamb-anchor system comprising four adjustable anchor mounts 16A-D as suggested in FIG. 1. Each of first and second adjustable anchor mounts 16A, 16B interconnect an outer end of first wall panel 161 and first doorjamb 261. Each of third and fourth adjustable anchor mounts 16C, 16D interconnect second doorjamb 262 and an outer end of second wall panel 162. Each adjustable anchor mount is a tension bolt in an illustrative embodiment. These tension bolts are operable to allow a user to change the width of gate unit 12.

Swing-direction controller 143 is coupled to a lower portion of swinging panel 141 as shown, for example, in FIG. 1. Swing-direction controller 143 includes a tube mount 143M and is configured to pivot about and slide up and down along a tube 141T included in swinging panel. Swing-direction controller 143 also includes a motion-blocker flange 143F coupled to and arranged to extend downwardly from tube mount 143M as shown, for example, in FIG. 1. Swing-direction controller 143 is shown in a neutral raised position in FIG. 1 in which a free end of motion-blocker flange 143F is at rest on a top surface of a horizontal tube-support bar 141B included in swinging panel 141. As suggested in FIG. 3, swing-direction controller 143 can be rotated in a clockwise direction and moved downwardly on tube 141T to cause motion-blocker flange 143F to extend downwardly below horizontal tube-support bar 141B. In this lower position, motion-blocker flange 143F is arranged to lie along an outer portion of tube-support bar 141B to engage the horizontally extending foundation rail 160 included in gate mount 16 and located under gate 14 to block inward swinging movement (i.e., out of the page) of gate 14 as shown, for example, in FIG. 3. Swing-direction controller 143 can be repositioned to block outward swinging movement (i.e., into the page) of gate 14 by lifting swing-direction controller 143 to slide upwardly along tube 141T and rotating controller 143 180° in a clockwise direction to cause motion-blocker flange 143F to lie along an opposite inner portion of tube-support bar 141B.

Panel retainer 144 is coupled to a lower portion of swinging panel 141 of gate 14 as shown, for example, in FIG. 1. Swing-direction controller 143 is positioned to lie between panel retainer 144 and lower hinge 16L as also shown in FIG. 1. Panel retainer 144 is arranged to move in a vertical direction when it comes into contact with the horizontally extending foundation rail 160 included in gate mount 16 and located under gate 14. After panel retainer 144 moves up and then back down, foundation rail 160 extends into a downwardly opening notch formed in a U-shaped retainer 144R included in panel retainer 144 to block swinging panel 141 of gate 14 from swinging about vertical pivot axis 18 and thus help to retain gate 14 in a closed and locked position relative to gate mount 16.

Gate mount 16 further includes an upper hinge 16U and a lower hinge 16L as shown, for example, in FIG. 1. Upper and lower hinges 16U, 16L are each coupled to swinging panel 141 of gate 14 and cooperate to establish vertical pivot axis 18. Upper hinge 16U is configured to house a portion of gate-open signaler 20 in an illustrative embodiment and is also coupled to first wall panel 161 of gate mount 16 as suggested in FIGS. 1 and 2. Lower hinge 16L is also coupled, for example, to foundation rail 160 of gate mount 16 as suggested in FIG. 1. It is within the scope of the present disclosure to associate gate-open signaler 20 with lower hinge 16L instead of upper hinge 16U.

Upper hinge 16U includes a pivot 30 coupled to swinging panel 141 of gate 14 to rotate therewith about vertical pivot axis 18 and a stationary pivot support 40 coupled to stationary first wall panel 161 of gate mount 16 as suggested in FIGS. 1 and 8-10. Pivot support 40 is configured to support pivot 30 for rotation about vertical pivot axis 18 to free swinging panel 141 of gate 14 to swing about vertical pivot axis 18 between opened and closed positions as suggested in FIGS. 1 and 3-7 when gate 14 is unlocked.

Figure 9:
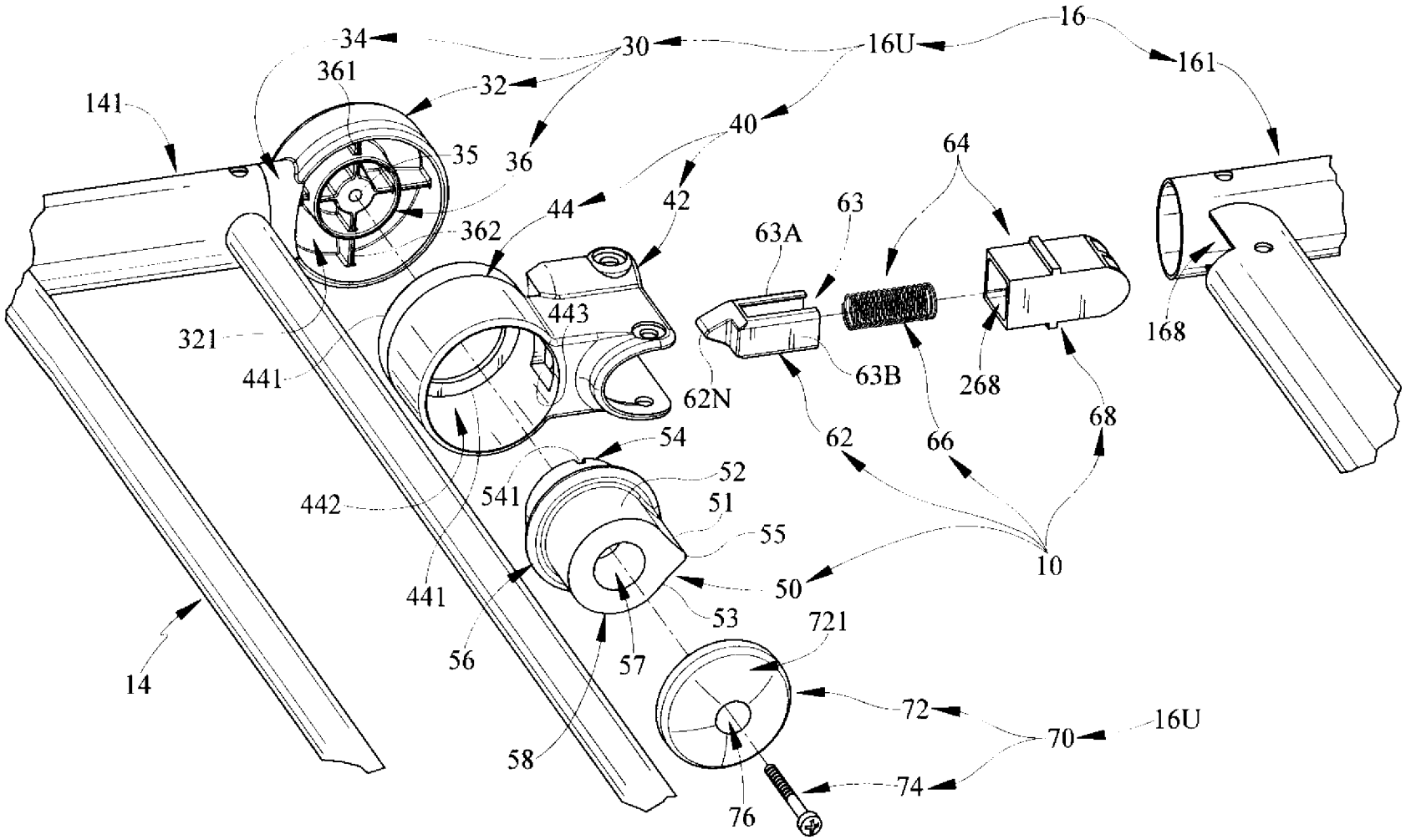
FIG. 9 is a second exploded perspective view of the components shown in FIG. 8.

Pivot 30 includes a rotatable shell 32, a shell mount 34, and a cam mount 36 as shown, for example, in FIG. 9. Rotatable shell 32 is mounted on a ring-shaped rim 441 of pivot support 40 for rotation about vertical pivot axis 18. Shell mount 34 is coupled to each of rotatable shell 32 and swinging panel 141 of gate 14 to help support gate 14 for pivotable movement about vertical pivot axis 18 during rotation of rotatable shell 32 of pivot 30 on ring-shaped rim 441 of pivot support 40. Cam mount 36 is coupled to rotatable shell 32 and located in a downwardly opening cavity 321 formed in rotatable shell 32 as shown, for example, in FIG. 9. Cam mount 36 is associated with a cam 50 that is included in gate-open signaler 10 and arranged to extend upwardly into shell cavity 321 and lie in an outer barrel chamber 442 formed in pivot support 40 as suggested in FIGS. 8-10. Cam mount 36 is linked to cam 50 to cause cam 50 to rotate about vertical pivot axis 18 in response to swinging movement of gate 14 about vertical pivot axis 18.

Figure 10:
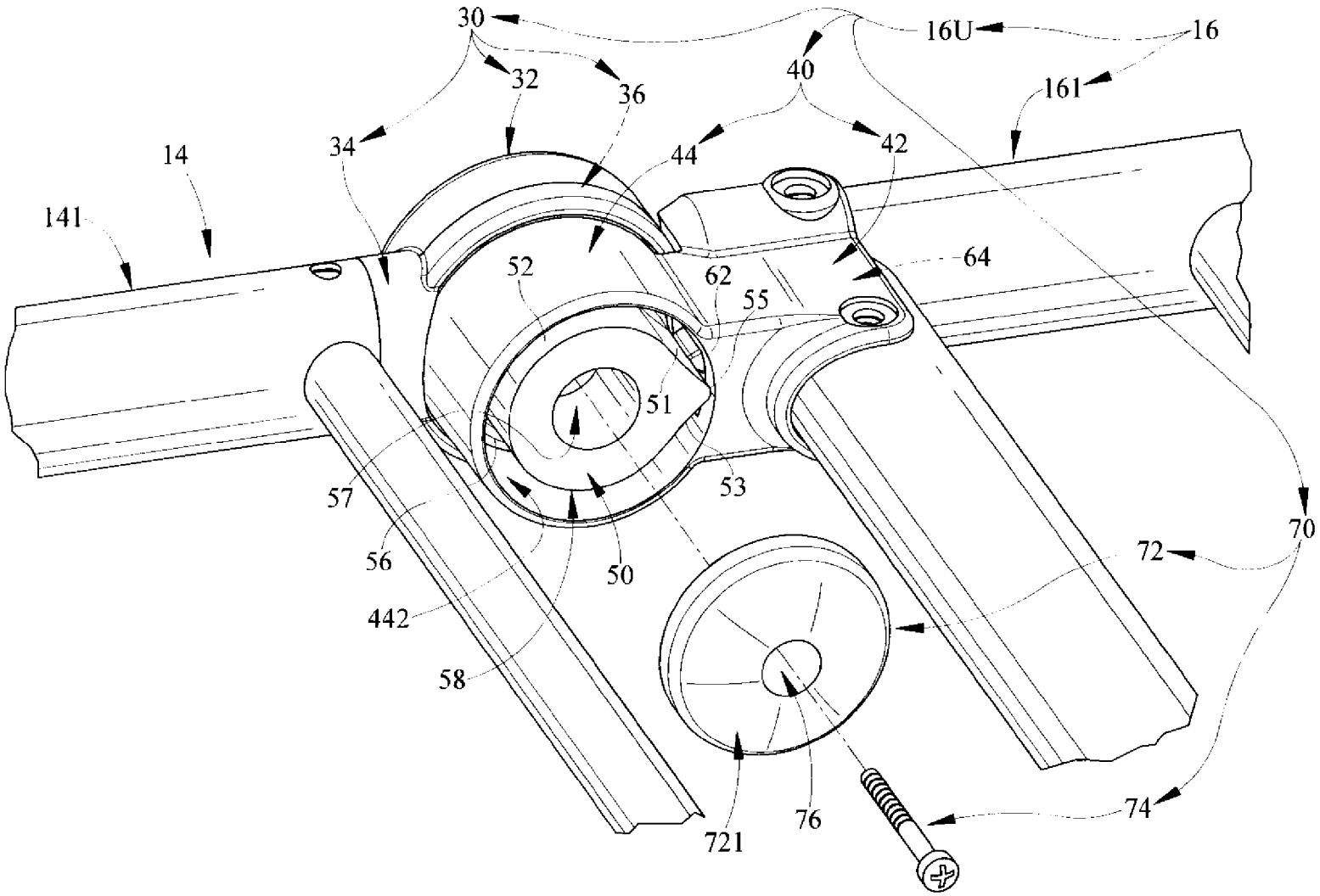
FIG. 10 is an enlarged partial perspective view of components shown in FIGS. 8 and 9 after most of the assembly has been completed and showing engagement of the nose of the cam follower on a ridge included in the cam placed in an interior region of a barrel included in the upper hinge before a cam retainer including a rotatable cap and cap fastener is coupled to a pivot included in the upper hinge and mounted on a swinging panel in the gate as suggested in FIG. 8.
Figure 10A:
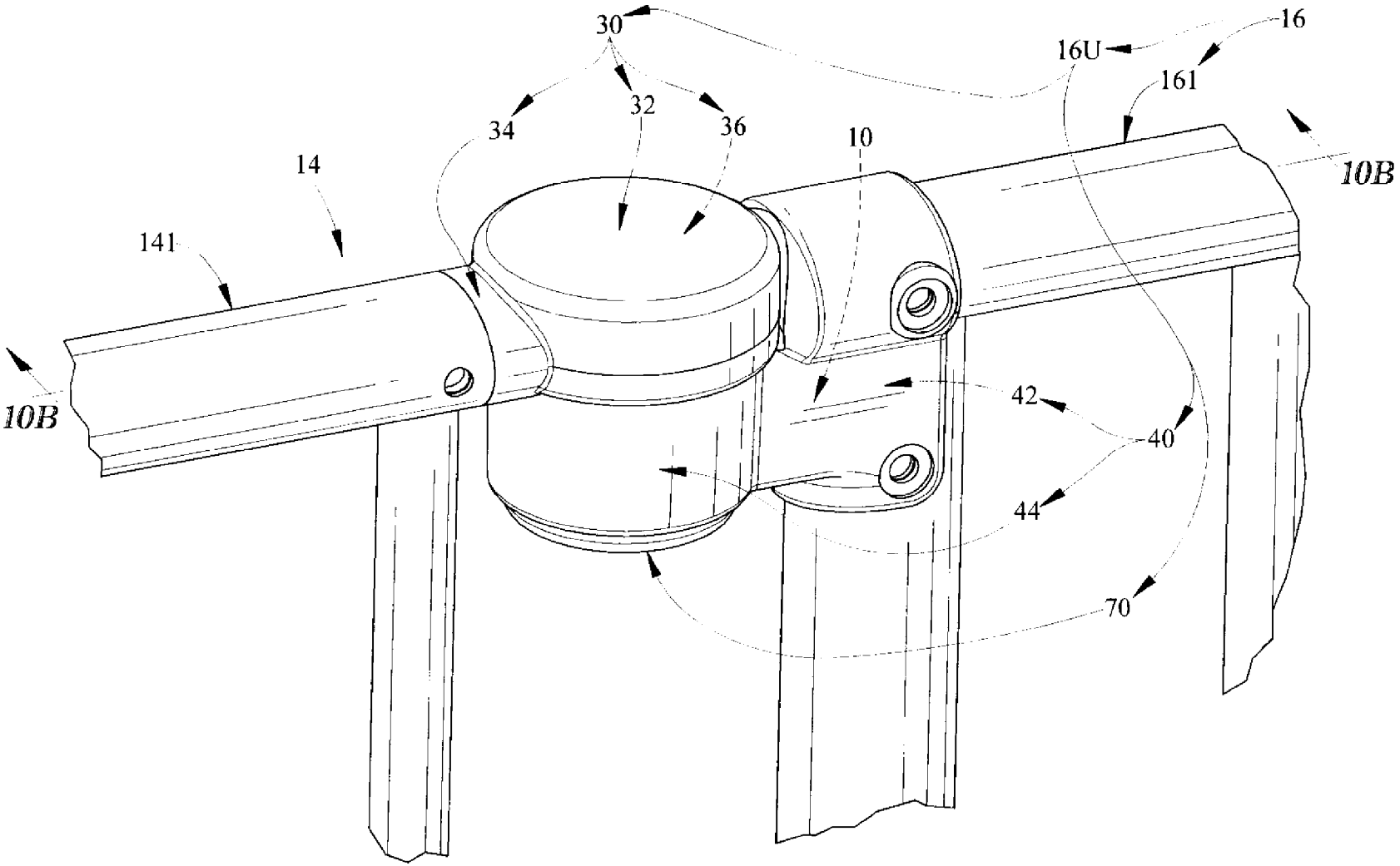
FIG. 10A is a partial perspective view similar to FIG. 10 after the upper hinge of the gate mount has been assembled.
Figure 10B:
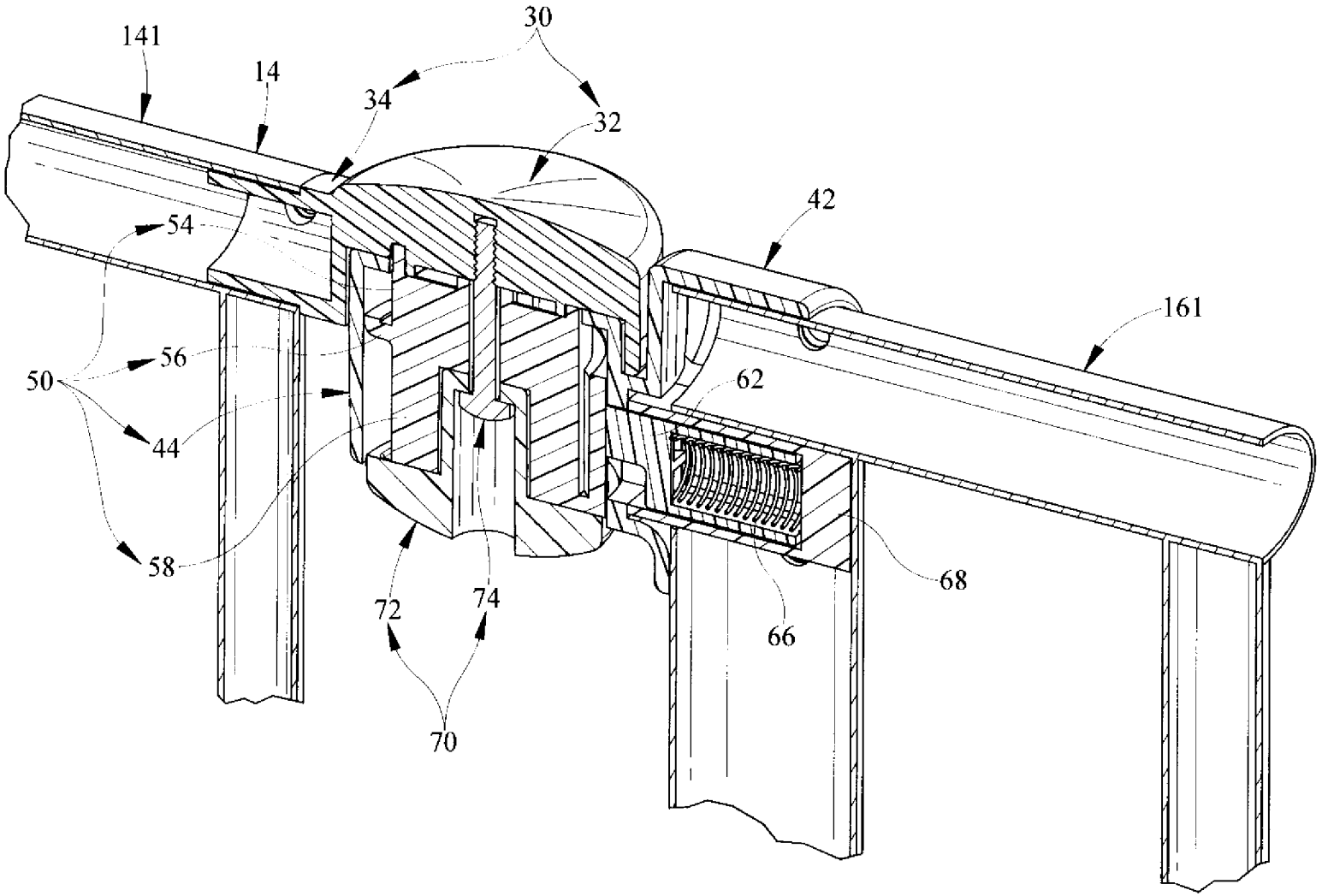
FIG. 10B is a sectional view taken along line 10B-10B of FIG. 10A showing the components of the gate-open signaler in their assembled and deployed positions inside the upper hinge and the first wall panel of the gate mount.

Pivot support 40 includes a barrel-support bracket 42 coupled to an upper portion of first wall panel 161 and a barrel 44 coupled to a free end of barrel-support bracket 42 and arranged to underlie and engage pivot 30 as suggested in FIGS. 8-10. Barrel-support bracket 42 is retained in a stationary position on first wall panel 161 of gate mount 16 using any suitable means as suggested in FIG. 10. Barrel 44 includes a ring-shaped rim 441 on which rotatable shell 32 of pivot 30 rides and rotates during swinging movement of gate 14 about vertical pivot axis 18. Barrel 44 is formed to include an upwardly and downwardly opening chamber 442 sized and shaped to receive therein a lower portion of a cam 50 included in gate-open signaler 10 as suggested in FIGS. 8 and 9 and shown, for example, in FIG. 10.

Lower hinge 16L includes a pivot 130 and a pivot support 140 as shown, for example, in FIG. 1. Pivot support 140 is an upstanding pin coupled to foundation rail 160 of gate mount 16. Pivot 130 is coupled to a lower portion of swinging panel 141 and is configured to mate with the underlying pivot support 140 to support pivot 130 for rotation on pivot support 140 about vertical pivot axis 18 to free swinging panel 141 of gate 14 to swing about vertical pivot axis 18 between opened and closed positions when gate 14 is unlocked.

Gate-open signaler 10 is configured always to move gate 14 automatically about vertical pivot axis 18 to a position that establishes a visible clearance gap 11 and thus is clearly opened as suggested in FIGS. 5 and 6 unless a caregiver first moves gate 14 to the closed position and then causes latch 20 carried on gate 14 to engage gate mount 16 to establish a locked mode and retain gate 14 in the closed position as suggested in FIG. 7. In an illustrative embodiment, gate-open signaler 10 includes a cam 50 anchored to upper hinge 16U included in gate mount 16 and cam rotator 60 including a cam follower 62 and a force generator 64 including a spring 66 and a spring mount 68 as suggested in FIGS. 2 and 8-10.

Cam 50 includes a base 54, a ring 56, and a body 58 as shown, for example, in FIGS. 8 and 9. Base 54 is configured to mate with cam mount 36 included in pivot 30 to cause cam 50 to rotate about vertical pivot axis 18 in unison with pivot 30 during swinging movement of gate 14 about vertical pivot axis 18 between opened and closed positions. Ring 54 and body 58 are sized and shaped to lie substantially inside chamber 442 formed in barrel 44 of pivot support 40. A cylindrical exterior surface of ring 54 is arranged to lie in rotative bearing engagement with a cylindrical interior surface of barrel 44 as suggested in FIGS. 9 and 10 to support cam 50 for rotation about vertical pivot axis 18 during rotation of pivot 30 about vertical pivot axis 18 as gate 14 swings between opened and closed positions. Body 58 of cam 50 is arranged to engage the spring-loaded cam follower 62 at all times, whether gate 14 is opened or closed and locked or unlocked.

Base 54 of cam 50 is cylinder-shaped and sized to be extended upwardly through an opening 4410 bounded by a circular inner edge of ring-shaped rim 441 of barrel 44 as suggested in FIG. 9. Base 54 is formed to include two (diametrically opposed) upwardly opening rib-receiving notches 541, 542 as suggested in FIG. 8. When cam base 54 is mated with cam mount 36, a first rib 361 included in cam mount 36 is arranged to extend into the first rib-receiving notch 54 formed in base 54 and a second rib 362 included in cam mount 36 is arranged to extend into the second rib-receiving notch 542 formed in base 54 to link cam 50 to rotate with pivot 30 about vertical pivot axis 18 during swinging movement of gate 14 about vertical pivot axis 18 between opened and closed positions.

Body 58 of cam 50 is formed to include first, second, and third cam surfaces 51, 52, 53, and a follower-stop edge or ridge 55 arranged to interconnect first and third cam surfaces 51, 53 as suggested in FIGS. 8-13. First and third cam surfaces 51 are substantially flat and arranged to converge in a direction toward cam follower 62 and cooperate to form a dihedral included angle 95 therebetween of about 95° as suggested in FIG. 13. Follower-stop edge 55 is a very short segment or ridge arranged to interconnect right-side edges of first and third cam surfaces 51, 53 and to engage the nose 62N of the spring-loaded cam follower 62 when gate 14 is in the closed position as shown, for example, in FIG. 13. The limited cam angle of each first and third cam surfaces 51, 53 minimizes acceleration of gate 14 during opening. Second cam surface 52 is cylinder-shaped in part in an illustrative embodiment as suggested in FIGS. 9 and 13 and is arranged to interconnect left-side edges of first and third cam surfaces 51, 53 as shown, for example, in FIG. 13. It is within the scope of the present disclosure to provide second cam surface 52 with a frustoconical shape wherein the wider diameter is located adjacent to ring 56.

A cam retainer 70 comprising a rotatable cap 72 and a cap fastener 74 is also included in upper hinge 16U as suggested in FIGS. 2 and 8-10. Cap 72 is arranged to underlie cam 50 and is coupled to rotatable shell 32 of pivot 30 by cap fastener 74 so that pivot 30 and cam retainer 70 rotate together about vertical pivot axis 18 during swinging movement of gate 14 about vertical pivot axis 18. Rotatable shell 32 is arranged to lie above the barrel 44 and the cam 50 located in barrel chamber 442 and rotatable cap 72 is arranged to lie below barrel 44 and cam 50 as suggested in FIG. 10. Shell 32 and cap 72 cooperate with cap fastener 74 to retain cam 50 in barrel chamber 442 during rotation of rotatable shell 32 and rotatable cap 72 relative to barrel 44 about vertical pivot axis 18.

Rotatable cap 72 includes a bowl-shaped plate 721 and a plate-support post 722 coupled to plate 721 as shown, for example, in FIG. 8. Plate-support post 722 is arranged to extend upwardly away from plate 721 into an aperture 57 formed in cam 50 as suggested in FIGS. 8-10. A central passageway 76 is formed in plate 721 and plate-support post 722 for receiving cap fastener 74 therein. Cap fastener 74 also extends through a central passageway 59 formed in cam 50 as suggested in FIG. 8 to mate with a central fastener receiver 35 formed in pivot 30 as suggested in FIG. 9 so as to retain each of rotatable shell 32 and rotatable cap 72 in rotatable engagement while the barrel 44 of pivot support 40 is trapped therebetween.

Figure 11:
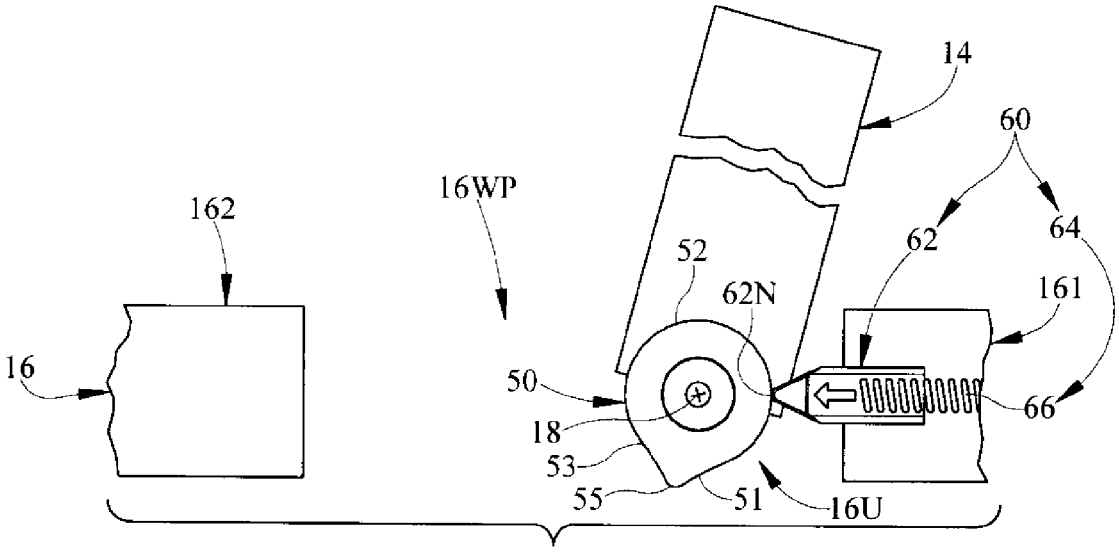
FIG. 11 is a diagrammatic view showing a force (represented by a left-facing double-arrow icon to the left of the spring) generated by the compressed spring included in the gate-open signaler and applied to a cylinder-shaped exterior second cam surface of the cam body of the cam via the cam follower when the gate is in a first (widely) opened position.
Figure 12:
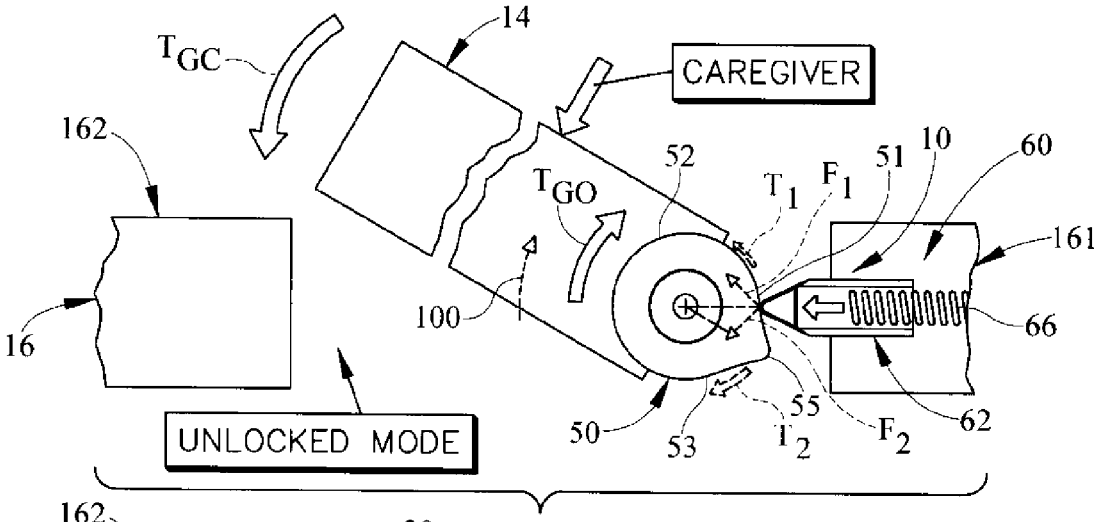
FIG. 12 is a diagrammatic view similar to FIG. 11 showing the gate in a second (narrowly) opened position such as shown in FIG. 5 and suggesting that the force generated by the compressed spring included in the gate-open signaler will move the cam follower (relative to the stationary spring mount that is coupled to the gate mount) to apply a force that acts on an exterior first cam surface of the cam and is split simultaneously into a first force component $F_1$ that acts to apply a small counterclockwise torque $T_1$ to the rotatable cam and a second force component $F_2$ that acts to apply a relatively larger clockwise torque $T_2$ to the rotatable cam so that the resulting torque applied to the rotatable cam is a clockwise gate-opening torque $T_{GO}$ (wherein $T_{GO}=T_2-T_1$) that causes the gate to pivot automatically about the vertical pivot axis in a clockwise direction toward an opened position unless a large enough gate-closure pushing force is applied by a person to the gate to cause a relatively larger counterclockwise gate-closing torque $T_{GC}$ to be applied to the gate to counteract clockwise gate-opening torque $T_{GO}$ and pivot the gate about the vertical pivot axis toward the closed position shown in FIG. 13.
Figure 13:
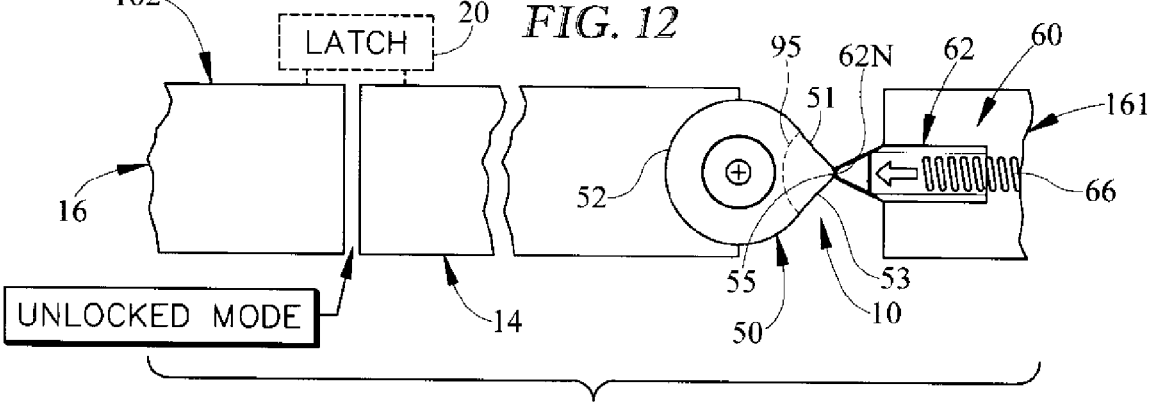
FIG. 13 is a diagrammatic view similar to FIGS. 11 and 12 showing that the gate has been moved by the person to the closed position and that the locked mode has been established (using any suitable means such as engagement of a latch carried on the gate with the gate mount) to retain the gate in the closed position and thereby block the clockwise gate-opening torque $T_{GO}$ that is always applied to the gate by the gate-open signaler from moving the gate about the vertical pivot axis to a clearly opened position.

Gate mover 60 of gate-open signaler 10 is engaged with and acts upon cam 50 as suggested in FIGS. 11-13. Gate mover 60 includes cam follower 62 and a force generator 64 including a spring 66 and a spring mount 68 as suggested in FIGS. 2 and 8-10. Cam follower 62 is constrained to move back and forth along a line normal to vertical pivot axis 18 as suggested in FIGS. 10B and 11-13.

Cam follower 62 includes a cam nose 62N arranged and configured to engage and ride on cam surfaces 51-53 and also to engage follower-stop edge (ridge) 55 as suggested in FIGS. 11-13. Cam follower 62 also includes a spring receiver 63 formed between two cantilevered planks 63A, 63B coupled at one end to cam nose 62N and arranged to extend rearwardly therefrom in spaced-apart parallel relation to one another as suggested in FIG. 8. A first end of spring 66 is arranged to extend into spring receiver 63 as suggested in FIGS. 2, 8, and 9.

Spring mount 68 is sized to fit into a mount-receiving chamber 168 formed in first wall panel 161 of gate mount 16 as suggested in FIGS. 2, 8, and 9. Spring mount 68 is retained in a stationary position in chamber 168. Spring mount 68 is formed to include chamber means 268 for receiving a second end of spring 66 and planks 63A, 63B of spring receiver 63 therein as suggested in FIGS. 2, 8, and 9.

Spring 66 is a coiled compression spring in an illustrative embodiment as suggested in FIGS. 8 and 9. Spring 66 is configured to store energy when compressed as suggested in FIGS. 2, 8, and 9. Spring 66 is expansible to provide means for applying a force to urge cam follower 62 away from first wall panel 161 of gate mount 16 and through a cam-follower aperture 443 formed in barrel 44 as shown in FIG. 9 to cause cam nose 62N always to engage cam 50 even though cam 50 rotates with pivot 50 about vertical pivot axis 18 during swinging motion of gate 14 about vertical pivot axis 18 as suggested in FIGS. 11-13.

An illustrative sequence is provided in FIGS. 4-7 to show operation of the gate-open signaler 10 always to move a gate 14 automatically to a position that is clearly opened unless a caregiver first moves gate 14 to the closed position and then causes a latch 20 carried on gate 14 to engage gate mount 16 to establish a locked mode and retain gate 14 in the closed position. A diagrammatic top plan view is provided in FIG. 4 to show the gate 14 in a fully opened position and suggesting that gate 14 will move toward a closed position in response to application of a FIRST PUSHING FORCE by a caregiver.

In some instances, gate 14 may be closed or nearly closed, but the gate 14 is actually unlocked as suggested in FIG. 5. In such a case, a caregiver has moved the gate 14 in a counterclockwise direction nearly to the closed position but then released the gate 14 while it is still in unlocked mode (and before it reaches locked mode). Gate-open signaler 10 then functions automatically to release energy stored in spring 66 to apply a clockwise torque (curved double arrow icon) to gate 14 to cause gate 14 to move about vertical pivot axis 18 away from the closed position toward a clearly opened position shown in FIG. 6. A visible clearance gap 11 is thus created between a free left-end edge 14E of gate 14 and a right-end edge of a second wall panel 162 of gate mount 16 whenever gate 14 is unlocked and closed or nearly closed.

Gate-open signaler 10 has operated as suggested in FIGS. 5 and 6 to pivot gate 14 about vertical pivot axis 18 in a clockwise direction through an acute displacement angle θ to an opened (non-closed) position automatically to establish an unlocked mode of gate 14. The acute displacement angle θ is about 12° in an illustrative embodiment. This provides a visual lock-status signal to a nearby observer that gate 14 is located in the opened position and maintained in the opened position until a SECOND PUSHING FORCE is applied to gate 14 to once again move gate 14 toward the closed position.

Gate 14 has been moved about vertical pivot axis 18 in the counterclockwise direction to the closed position as suggested in FIG. 7 in response to application of the SECOND PUSHING FORCE to gate 14. A locked mode for the gate 14 has been established (using any suitable means such as by engagement of a latch 20 carried on gate 14 with gate mount 16) as suggested in FIG. 7 to retain gate 14 in the closed position in the locked mode so that the locked mode of gate 14 is visually apparent to a nearby observer.

When gate 14 is closed and locked as suggested in FIG. 7, spring cam follower 62 is unable to apply a force to cam 50 that will generate a torque that will cause cam 50, pivot 30, and gate 14 to rotate about vertical pivot axis 18. Nose 62N of the cam follower 62 engages a ridge 55 included in cam 50 placed in an interior region 442 of a barrel 44 included in upper hinge 16U as suggested in FIGS. 8 and 13 to block rotation of cam 50, pivot 30, and gate 14 about vertical pivot axis 18 and away from the closed and locked position.

A diagrammatic view provided in FIG. 11 shows a force (represented by a left-facing double-arrow icon to the left of the spring) generated by the compressed spring 66 included in the gate-open signaler 10. This force is applied to a cylindrical portion 52 of the cam body 50 of the cam 50 via the cam follower 62 when the gate 14 is in a first (widely) opened position.

A diagrammatic view provided in FIG. 12 shows the gate 14 in a second (narrowly) opened position such as shown in FIG. 5 and suggesting that the force generated by the compressed spring 16 included in the gate-open signaler 10 will move the cam follower 62 (relative to the stationary spring mount 68 that is coupled to the gate mount 16) to apply a force that acts on an exterior surface of the cam 50 and is split simultaneously into a first force component $F_1$ that acts to apply a small counterclockwise torque $T_1$ to the rotatable cam 50 and a second force component $F_2$ that acts to apply a relatively larger clockwise torque $T_2$ to the rotatable cam 50 so that the resulting torque applied to the rotatable cam is a clockwise gate-opening torque $T_{GO}$ (wherein $T_{GO}=T_2-T_1$) that causes gate 14 to pivot automatically about vertical pivot axis 18 in a clockwise direction 100 toward an opened position unless a large enough gate-closure pushing force is applied by a caregiver to gate 14 to cause a relatively larger counterclockwise gate-closing torque $T_{GC}$ to be applied to gate 14 to counteract clockwise gate-opening torque $T_{GO}$ and pivot gate 14 about vertical pivot axis 18 toward the closed position shown in FIG. 13.

A diagrammatic view is provided in FIG. 13 to show that the gate 14 has been moved by the caregiver to the closed position. The locked mode has been established (using any suitable means such as engagement of a latch 20 carried on the gate 14 with the gate mount) 16 to retain the gate 14 in the closed position as also suggested in FIG. 13.

The invention claimed is:

1. A gate unit comprising a doorway barrier including a gate mount adapted to mate with a door frame bordering a doorway and a gate mounted on the gate mount for pivotable movement about a pivot axis between a closed position closing a walkway passage formed in the gate mount to block movement of a person through the walkway passage and an opened position opening the walkway passage to allow movement of a person through the walkway passage, a releasable latch mounted for movement relative to the doorway barrier to engage the gate and the gate mount simultaneously to retain the gate in the closed position to establish a locked mode of the gate, gate-open signaler means for moving the gate about the pivot axis from an unlocked mode and the closed position through a displacement angle to the opened position automatically to establish the opened position and the unlocked mode of the gate thereby providing a visual lock-status signal to a nearby observer that the gate is located in the opened position and maintained in the unlocked mode, wherein the gate-open signaler means includes a cam having a ridge, the cam mounted for rotation about the pivot axis in a first chamber formed in the pivot support of the hinge and coupled to the pivot to rotate therewith and a cam rotator having a nose, the cam rotator coupled to the first wall panel and configured to provide means for rotating the cam about the pivot axis to cause the pivot and the gate coupled to the pivot to rotate as a unit about the pivot axis to move the gate to the opened position unless the gate is retained in the closed position and maintained in the locked mode, and further wherein in the closed position the nose and the ridge are aligned and abutting each other.

2. The gate unit of claim 1, wherein the displacement angle is about 12°.

3. The gate unit of claim 1, wherein the gate mount includes a first wall panel adapted to lie in the doorway and a hinge coupled to the first wall panel and configured to establish the pivot axis, the hinge includes a pivot support coupled to the first wall panel and a pivot coupled to the gate and supported for rotation about the pivot axis on the pivot support.

4. The gate unit of claim 3, wherein the cam rotator includes a cam follower and a spring configured and arranged to yieldably urge the cam follower to move relative to the gate mount to engage the cam.

5. The gate unit of claim 4, wherein the cam rotator further includes a spring mount coupled to the first wall panel and the spring mount is formed to include a second chamber, a first end of the spring is arranged to engage the cam follower, and a second end of the spring is arranged to extend into the second chamber formed in the spring mount.

6. The gate unit of claim 3, wherein the pivot support includes a barrel-support bracket coupled to the first wall panel and a barrel coupled to the barrel-support racket and formed to include the chamber, and the cam includes a base coupled to the pivot, a ring arranged to lie in the chamber and to lie in rotative bearing engagement with an interior surface of the barrel to support the cam for rotation about the pivot axis, and a body arranged to lie in the chamber and to engage the cam rotator.

7. The gate unit of claim 6, wherein the barrel is formed to include a cam-follower aperture opening into the chamber formed in the barrel and the cam rotator includes a cam follower arranged to extend through and move in the cam-follower aperture and spring means for yieldably urging the cam follower to engage a cam surface provided on the body.

8. The gate unit of claim 7, wherein the cam follower is moved by the spring means to apply a force to the cam surface on the body of the cam that is split simultaneously into a first force component that acts to apply a small rotation-inducing first torque to the cam and a second force component that acts to apply an opposite relatively larger rotation-inducing second torque to the cam to cause a resulting torque to be applied to the cam to rotate the cam, pivot, and gate about the pivot axis toward an opened position of the gate to provide the visible lock-status signal unless a gate-closure pushing force is applied to the gate to counteract the resulting torque and pivot the gate to the closed position to establish the locked mode.

9. The gate unit of claim 7, wherein the barrel support bracket is formed to include an interior region communicating with the cam-follower aperture formed in the barrel and containing at least a portion of the cam follower and the spring means.

10. The gate unit of claim 6, wherein the gate mount further includes a cam retainer including a cap arranged to lie in spaced-apart relation to the pivot to locate the barrel and the cam therebetween and a cap fastener coupled to the cap and to the pivot to retain the cap in a stationary position on the barrel to retain the cam in the chamber formed in the barrel without inhibiting rotation of the barrel and the pivot about the pivot axis.

11. The gate unit of claim 10, wherein the cam retainer is arranged to lie in a position between the gate and the first wall panel of the gate mount.

12. A gate unit comprising a doorway barrier including a gate mount adapted to mate with a door frame bordering a doorway and a gate mounted on the gate mount for movement between a closed position lying in substantially coplanar relation to the gate mount to close a walkway portion formed in the gate mount and a non-closed position lying in substantially non-coplanar relation to the gate mount to define a displacement angle therebetween, a releasable latch mounted for movement relative to the doorway barrier to block movement of the gate relative to the gate mount to retain the gate in the closed position to establish a locked mode of the gate, gate-open signaler means for automatically moving the gate relative to the gate mount through the displacement angle to the non-closed position to create a visible gap between an upright edge of the gate and the gate mount and to establish an unlocked mode, and the gate is maintained in the non-closed position and unlocked mode until a user moves the gate to the closed position and operates the latch to retain the gate in the closed position and locked mode so that the locked or unlocked mode of the gate is visually apparent to a nearby observer, wherein the gate-open signaler means includes a cam having a ridge, the cam mounted for rotation about the pivot axis in a first chamber formed in the pivot support of the hinge and coupled to the pivot to rotate therewith and a cam rotator having a nose, the cam rotator coupled to the first wall panel and configured to provide means for rotating the cam about the pivot axis to cause the pivot and the gate coupled to the pivot to rotate as a unit about the pivot axis to move the gate to the opened position unless the gate is retained in the dosed position and maintained in the locked mode, and further wherein in the closed position the nose and the ridge are aligned and abutting each other.

13. A gate unit comprising a doorway barrier including a gate mount adapted to mate with a door frame bordering a doorway and a gate mounted on the gate mount for movement relative to the gate mount about a vertical pivot axis between a closed position closing a walkway passage formed in the gate mount to block movement of a person through the walkway passage and a non-closed position that is different than the closed position, a releasable latch adapted for movement relative to the doorway barrier to block movement of the gate relative to the gate mount to retain the gate in the closed position to establish a locked mode of the gate, a gate-open signaler including a cam mounted for rotation relative to the gate mount about the vertical pivot axis and formed to include a first cam surface and a cam rotator including a cam follower arranged to move relative to the gate and force-generator means for moving the cam follower relative to the gate to engage and move along the first cam surface of the cam to cause the gate to move from the closed position to the non-closed position to establish an unlocked mode of the gate and provide a visual lock-status signal to a nearby observer that the gate is in the non-closed position and unlocked mode whenever the gate is not retained in the closed position and locked mode by the releasable latch so that the locked or unlocked mode of the gate is visually apparent to a nearby observer, wherein the gate-open signaler means includes a cam having a ridge, the cam mounted for rotation about the pivot axis in a first chamber formed in the pivot support of the hinge and coupled to the pivot to rotate therewith and a cam rotator having a nose, the cam rotator coupled to the first wall panel and configured to provide means for rotating the cam about the pivot axis to cause the pivot and the gate coupled to the pivot to rotate as a unit about the pivot axis to move the gate to the opened position unless the gate is retained in the closed position and maintained in the locked mode, and further wherein in the closed position the nose and the ridge are aligned and abutting each other.

14. The gate unit of claim 13, wherein the force-generator means includes a spring mount coupled to the gate mount and an extensible spring interposed between the spring mount and the cam follower.

15. The gate unit of claim 13, wherein the gate mount includes a wall framing a portion of the walkway passage and a pivot support coupled to the wall, the gate includes a swinging panel sized to occlude the walkway passage upon movement of the gate to the closed position and a pivot mounted for movement relative to the pivot support and coupled to the swinging panel to support the swinging panel for pivotable movement relative to the wall of the gate mount about the vertical pivot axis, and the cam follower is constrained to move along a line normal to the vertical pivot axis.

16. The gate unit of claim 15, wherein the cam includes a cam body formed to include the first cam surface and a cam ring coupled to the cam body and arranged to surround the cam body and the pivot support includes a barrel arranged to surround the cam ring and lie in rotative bearing engagement with the cam ring to support the swinging panel for pivotable movement about the vertical pivot axis.

17. The gate unit of claim 16, wherein the barrel is formed to include a cam-follower aperture and the cam follower is arranged to extend through and move back and forth in the cam-follower aperture along the line normal to the vertical pivot axis.

18. The gate unit of claim 16, wherein the cam body is formed to include a flange-receiving channel and the pivot includes a plate and a flange coupled to the plate and arranged to extend into the flange-receiving channel formed in the cam body to provide means for linking the cam about the vertical pivot axis with the gate during pivotable movement of the gate about the vertical pivot axis.

19. The gate unit of claim 13, wherein the gate is mounted on the gate mount for pivotable movement about a vertical pivot axis at the option of a caregiver in one of a clockwise direction to move from the closed position to the non-closed position and in a counterclockwise direction to move from the closed position to an alternative non-closed position, the cam is formed to include a second and a third cam surface, the third cam surface arranged to cooperate with the first cam surface to define an acute included angle between the first and third cam surfaces, and the cam follower is urged by the force-generator means to engage and move along the first cam surface to cause the gate to pivot in the clockwise direction to move from the closed position to the non-closed position in a first manner of operation of the gate unit and to engage and move along the third cam surface to cause the gate to pivot in the counterclockwise direction to the alternative non-closed position in a second manner of operation of the gate unit.

20. The gate unit of claim 19, wherein the first and third cam surfaces cooperate to form a follower-stop edge therebetween and the force-generator means moves the cam follower to engage the follower-stop edge whenever the gate is retained in the closed position and to engage the first cam surface whenever the gate is free to move from the closed position to the non-closed position and to engage the second cam surface whenever the gate is free to move from the closed position to the alternative non-closed position.

21. The gate unit of claim 20, wherein each of the first and third cam surfaces has a rectangular shape.

22. The gate unit of claim 21, wherein the cam body further includes a cylinder-shaped surface interconnecting the first and third cam surfaces and lying in spaced-apart relation to the follower-stop edge.

23. The gate unit of claim 20, wherein the cam includes, in series, a cam body formed to include the first, second, and third cam surfaces, a cam mount arranged to mate with the gate to link the cam to rotate with the gate about the vertical pivot axis, and a cam ring interposed between and coupled to the cam body and the cam mount and arranged to lie in rotative bearing engagement with a portion of the gate mount to support the gate for pivotable movement about the vertical pivot axis between the closed and non-closed positions.

24. The gate unit of claim 23, wherein the force-generator means is configured to pivot the gate through a displacement angle of at least 10° during movement of the gate from the closed position to each of the non-closed position and the alternative non-closed position.

* * * * *